US010681973B2

(12) United States Patent
Park

(10) Patent No.: US 10,681,973 B2
(45) Date of Patent: Jun. 16, 2020

(54) OPTIMAL BRUSH CONFIGURATIONS FOR GUMMY FORMULATIONS

(71) Applicant: L'OREAL, Paris (FR)

(72) Inventor: Kyoo Jin Park, Leonia, NJ (US)

(73) Assignee: L'OREAL, Paris (FR)

( * ) Notice: Subject to any disclaimer, the term of this patent is extended or adjusted under 35 U.S.C. 154(b) by 0 days.

(21) Appl. No.: 16/118,893

(22) Filed: Aug. 31, 2018

(65) Prior Publication Data

US 2020/0069033 A1 Mar. 5, 2020

(51) Int. Cl.

| | |
|---|---|
| ***A45D 34/00*** | (2006.01) |
| ***A45D 40/26*** | (2006.01) |
| ***A46B 9/02*** | (2006.01) |
| ***A46B 11/00*** | (2006.01) |
| *A45D 34/04* | (2006.01) |
| *A46B 3/00* | (2006.01) |

(52) U.S. Cl.

CPC ..... *A45D 40/267* (2013.01); *A46B 9/021* (2013.01); *A46B 11/0072* (2013.01); *A45D 34/045* (2013.01); *A46B 3/005* (2013.01); *A46B 2200/1053* (2013.01)

(58) Field of Classification Search

CPC ..... A46B 3/005; A46B 9/02; A46B 9/021; A46B 9/028

USPC ..... 401/118–127, 129; 132/218, 317, 320

See application file for complete search history.

(56) References Cited

U.S. PATENT DOCUMENTS

| | | | | |
|---|---|---|---|---|
| 8,201,566 | B2 | 6/2012 | Dumler et al. | |
| 8,393,338 | B2 | 3/2013 | Wyatt et al. | |
| 2003/0200979 | A1 | 10/2003 | Montoli et al. | |
| 2006/0070635 | A1 | 4/2006 | Dumler et al. | |
| 2007/0033759 | A1 | 2/2007 | Dumler | |
| 2008/0011317 | A1 | 1/2008 | Malvar et al. | |
| 2008/0083421 | A1 * | 4/2008 | Malvar | A45D 40/267 132/218 |

(Continued)

FOREIGN PATENT DOCUMENTS

| | | | |
|---|---|---|---|
| EP | 1752066 | A1 | 2/2007 |
| EP | 1992251 | A1 | 11/2008 |

(Continued)

OTHER PUBLICATIONS

International Search Report and Written Opinion, dated Nov. 11, 2019, issued in corresponding International Patent Application No. PCT/US2019/047392, filed Aug. 21, 2019, 15 pages.

*Primary Examiner* — David P Angwin
*Assistant Examiner* — Joshua R Wiljanen
(74) *Attorney, Agent, or Firm* — Christensen O'Connor Johnson Kindness PLLC

(57) ABSTRACT

In one aspect, the present disclosure provides a brush for applying a formulation, the brush having a core having an outer surface and a longitudinal axis, a plurality of bristle rings protruding from the core and spaced apart along the longitudinal axis, each bristle ring having at least 6 bristles spaced radially apart around the outer surface of the core, and a high density zone that covers at least a portion of the outer surface of the core, the high density zone having an equivalent 360 degree linear bristle density of 13 to 31 whole bristles per 0.5 mm of length along the outer surface of the core measured along the longitudinal axis, and a surface bristle density of 3 to 5 bristles per square millimeter of area of the outer surface of the core.

20 Claims, 11 Drawing Sheets

(56) References Cited

U.S. PATENT DOCUMENTS

| | | | | |
|---|---|---|---|---|
| 2008/0283078 | A1 | 11/2008 | Dumler et al. | |
| 2013/0315647 | A1* | 11/2013 | Gueret | A45D 40/265<br>401/122 |
| 2016/0360859 | A1* | 12/2016 | Uresti | A46B 9/021 |

FOREIGN PATENT DOCUMENTS

| | | | |
|---|---|---|---|
| FR | 2505633 | A1 | 5/1981 |
| JP | 2008114055 | A | 5/2008 |
| WO | 2012080936 | A2 | 6/2012 |

* cited by examiner

OPTIMAL BRUSH CONFIGURATIONS FOR GUMMY FORMULATIONS

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In one aspect, the present disclosure provides a brush for applying a formulation, the brush having a core having an outer surface and a longitudinal axis, a plurality of bristle rings protruding from the core and spaced apart along the longitudinal axis, each bristle ring having at least 6 bristles spaced radially apart around the outer surface of the core, and a high density zone that covers at least a portion of the outer surface of the core, the high density zone having an equivalent 360 degree linear bristle density of 13 to 31 whole bristles per 0.5 mm of length along the outer surface of the core measured along the longitudinal axis, and a surface bristle density of 3 to 5 bristles per square millimeter of area of the outer surface of the core.

In one aspect, a first bristle ring and a second bristle ring may be spaced apart by 0.1 mm to 0.3 mm, as measured along the longitudinal axis, between the nearest surfaces of the first bristle ring and the second bristle ring. The first bristle ring and the second bristle ring may be spaced apart by 0.15 mm to 0.25 mm. Each bristle in one of the first and second bristle rings may have a diameter of 0.125 mm to 0.175 mm.

In one aspect, no part of the brush may have a surface bristle density that exceeds 5 whole bristles per square millimeter of area of the outer surface of the core.

In one aspect, the high density zone may extend across a 1-90 degree sector of the outer surface of the core, about the longitudinal axis.

In one aspect, the high density zone may extend along a 10 mm-50 mm axial length of the outer surface of the core.

In one aspect, at least one bristle ring in the high density zone may include a first bristle length and a second bristle length. The at least one bristle ring may further include a third bristle length.

In one aspect, within a single bristle ring, no more than four bristles may have the same bristle length.

In one aspect, a difference between the first bristle length and the second bristle length may be at least 1 mm.

In one aspect, the core may have a cross sectional shape that results in, within at least one ring of the plurality of bristle rings, a first bristle length and a second bristle length. In one aspect, the cross sectional shape of the core may result in a third bristle length.

In one aspect, the core may comprise a first recess formed in an outer surface of the core, the first recess being configured to hold a formulation. The first recess may extend along the core in a direction substantially parallel to the longitudinal axis. The core may include a second recess located on an opposite side of the core from the first recess. The core may have an hourglass cross sectional shape.

In one aspect, the present disclosure provides a system for optimally applying a formulation, the system comprising a formulation stored within a container, a wiper secured within the container, and a brush as described above that is removably secured within the container.

In one aspect, the present disclosure provides a brush for holding a formulation, comprising a core having an outer surface, a longitudinal axis, a non-cylindrical cross sectional shape, and a first recess formed in or by the outer surface, the first recess being configured to hold a formulation, and a plurality of bristle rings protruding from the core and spaced apart along the longitudinal axis, each bristle ring having a plurality of bristles spaced radially apart around the outer surface of the core, wherein the cross sectional shape of the core results in, within at least one ring of the plurality of bristle rings, a first bristle length, a second bristle length, and a third bristle length.

In one aspect, the plurality of bristle rings may have an equivalent 360 degree bristle density of 13 to 31 whole bristles per 0.5 mm of length along the outer surface of the core measured along the longitudinal axis and a surface bristle density of 3 to 5 bristles per square millimeter of area of the outer surface of the core.

In one aspect, no two consecutive bristles in a single bristle ring may have the same bristle length.

In one aspect, the first recess may extend along the core in a direction substantially parallel to the longitudinal axis.

In one aspect, the core may include a second recess located on an opposite side of the core from the first recess.

In one aspect, the core may have an hourglass-shape.

DESCRIPTION OF THE DRAWINGS

The foregoing aspects and many of the attendant advantages of disclosed subject matter will become more readily appreciated as the same become better understood by reference to the following detailed description, when taken in conjunction with the accompanying drawings. It shall be appreciated that the figures below are not necessarily to scale, and are intended to facilitate understanding of the inventive concepts discussed herein.

DETAILED DESCRIPTION

The following description provides several examples of brushes that include bristle configurations designed to effectively apply formulations. e.g., cosmetic formulations, to fine hairs having a diameter of 0.05 mm to 0.1 mm, for example, eyelashes. In practice, brushes often carry a formulation on and around the bristles, and in gaps between bristles. A subject then applies the formulation by stroking the brush against the hairs. One challenge in applying formulations to such fine hairs is that the hairs often have a relatively small diameter as compared to gaps between brush bristles, such that formulation stored on the bristles cannot effectively transfer to the hairs. To an extent, this challenge can be mitigated by reducing the gap between adjacent bristles, which tends to increase bristle density on the brush. However, if bristles are too dense, then it becomes difficult for even fine hairs to enter the gap between adjacent bristles. Also, if the bristles are too dense, then it becomes difficult for the formulation to break up between the bristles, a condition that negatively affects how well the formulation transfers to the hairs. The foregoing problems are particularly acute for "gummy" formulations, which have a relatively high viscosity and tend to form clumps.

The inventive systems and brushes disclosed herein include one or more high density zones that are configured to efficiently and uniformly apply formulations—including gummy formulations—to fine hairs. Within the high density zone, both the linear bristle density relative to a core length and the overall bristle density relative to the surface area of the core contribute to this efficiency and uniformity. Some embodiments may include one or more reservoirs configured to hold formulation, to further improve brush performance. Various aspects discussed below generally relate to the high density zones of a brush. It is contemplated that the inventive brushes disclosed herein may have areas other than high density zones without deviating from the spirit of this disclosure.

Figure 1:
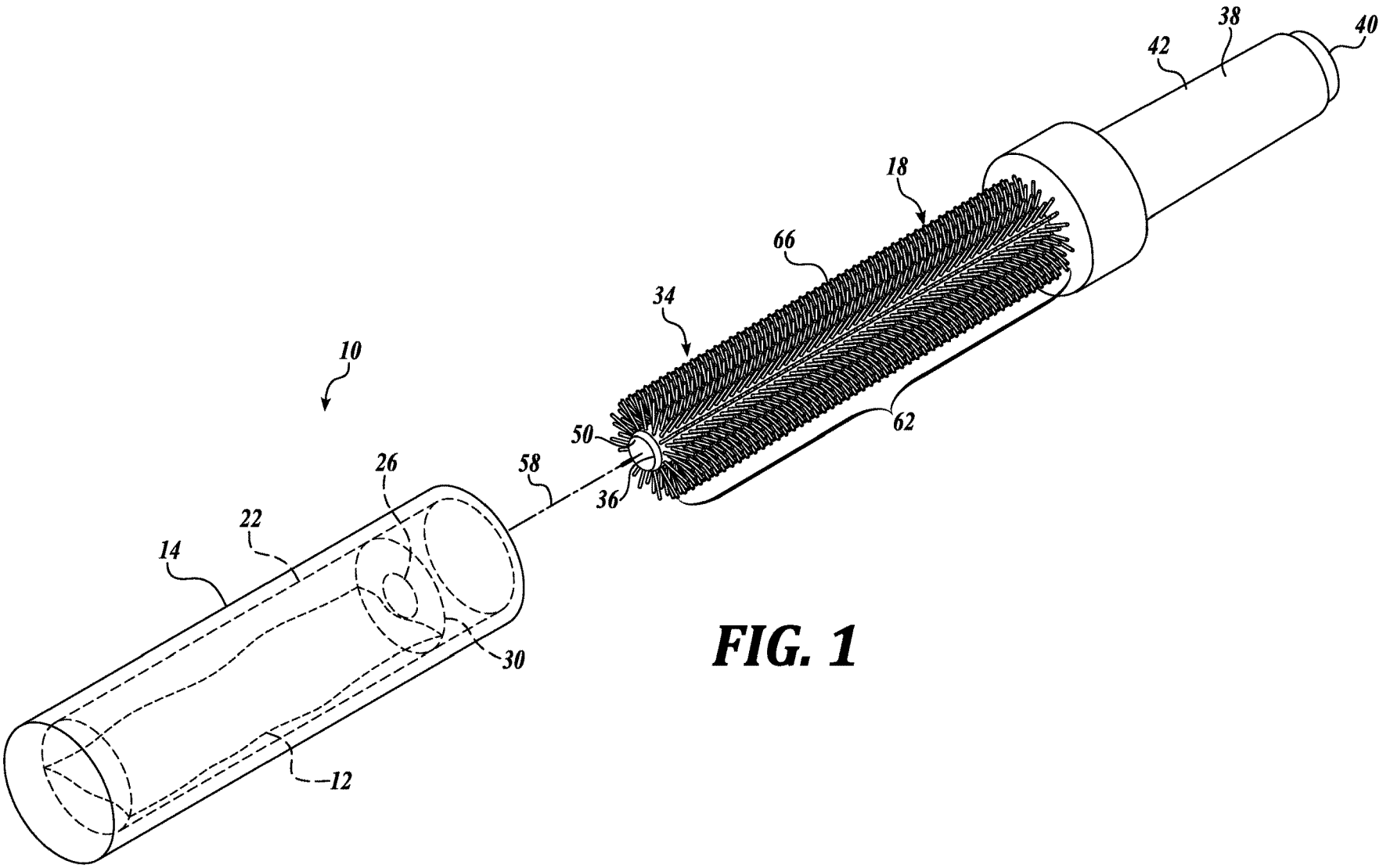
FIG. 1 is a perspective view of a representative system according to the present disclosure, including a representative example of a brush and a representative example of the container.

Referring now to FIG. 1, a representative system 10 is shown for storing and applying a formulation 12. In the embodiment shown, the system 10 includes a container 14 and a brush 18 having a plurality of bristles. The container 14 includes an internal chamber 22 for storing a formulation, e.g., mascara. A rigid or semi-rigid wiper 26 is affixed within the internal chamber 22, or formed integrally with the internal chamber 22 of the container 14, and is configured to "wipe" excess formulation 12 off the bristles of the brush 18 as the brush 18 is removed from the container 14. In the embodiment shown, the wiper 26 includes an internal opening 30 having a shape that may approximate a cross sectional shape of the brush 18. In some embodiments, such as embodiments having brushes with non-cylindrical cores, the wiper may have an internal opening that is not circular in order to approximate the cross section shape of the core. In some embodiments, the opening 30 may be somewhat smaller than the cross sectional shape of the brush 18.

The brush 18 may be releasably securable to the container 14, for example via a threaded coupling or other closure structure (not shown). The brush 18 is generally elongated, and includes a bristle section 34 and a handle 38. When the brush 18 is secured to the container 14, the bristle section 34 is inserted into the internal chamber 22 of the container 14 such that a distal end 36 extends through the internal opening 30 of the wiper 26 such that the bristle section 34 may contact the formulation 12 stored within the internal chamber 22. Once the bristle section 34 is removed, formulation 12 that has adhered to the brush 18 may then be applied to an object, such as hairs, by stroking the formulation-laden brush 18 against the object. The subject may occasionally reload the brush 18 by again inserting the distal end 36 into the internal chamber 22, optionally rotating the brush 18 within the chamber and/or shaking the container 14 to distribute formulation 12 around the brush 18, and then removing the brush 18.

Generally, the formulation may have a wide range of properties and compositions depending on the application. Gummy formulations, for example mascara, generally include water as well as a water-soluble or water-dispersible polymer. The gummy formulations generally are shear-thinning (pseudoplastic) and may have a viscosity of less than about 250 Pascal-seconds when measured at moderate/high shear rate of 5 $s^{-1}$. The concentration of polymer is generally less than about 40% by weight, such as less than about 30% by weight, such as 5%-30%. Any of the brushes described herein may be made, used, and/or sold as part of a system that includes a formulation, for example gummy formulations as described above.

Figure 2:
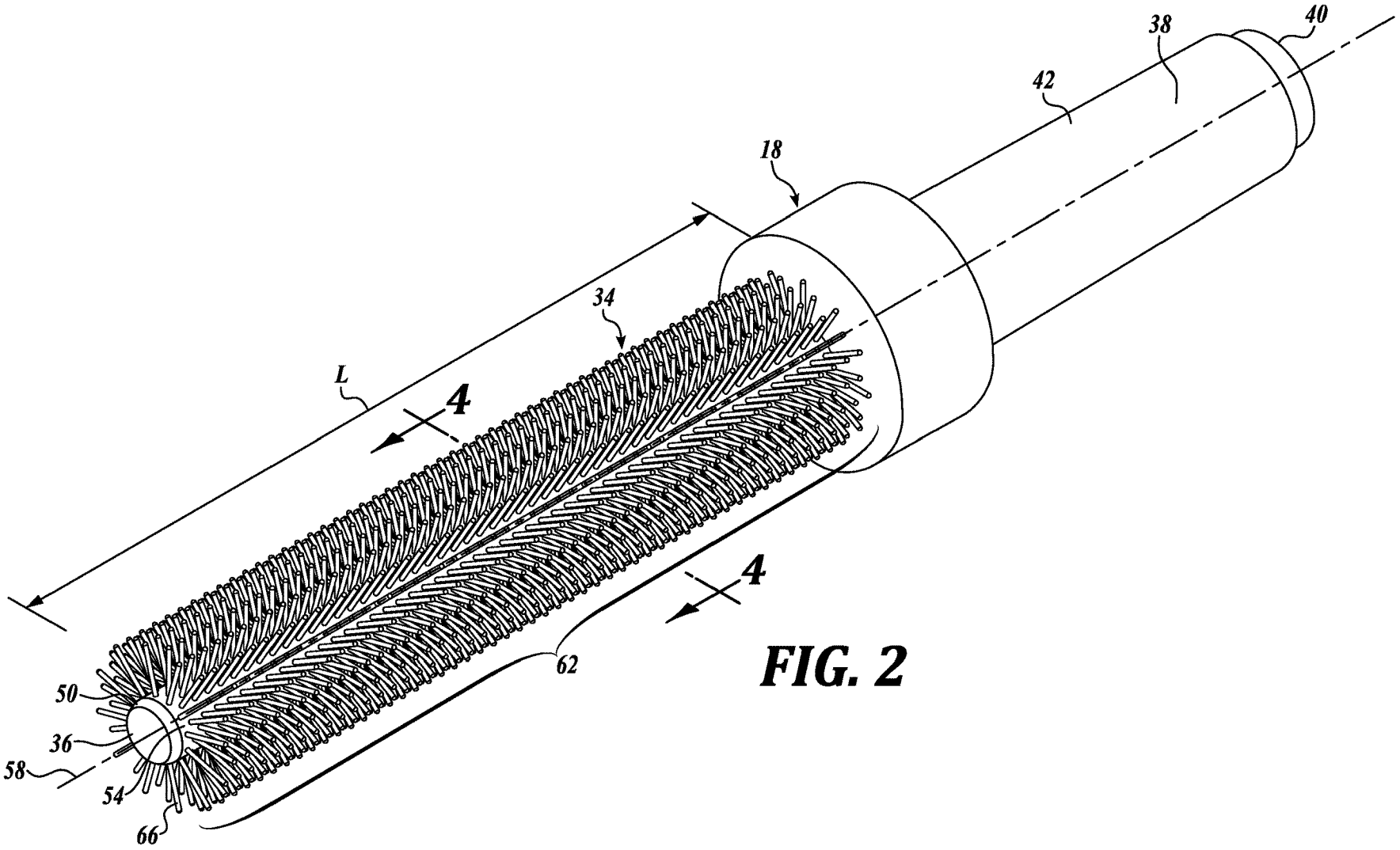
FIG. 2 is a perspective view of the brush of FIG. 1.

Referring now to FIG. 2, the brush 18 of FIG. 1 is shown without the container 14. It is contemplated that any of the brushes described herein may be sold as part of a system (such as system 10) that also includes a container having a wiper 26 and a formulation 12 contained within the internal chamber 22, or may be distributed or sold separately from the container.

As shown in FIG. 2, the bristle section 34 of the brush 18 includes a core 50 having a radial outer surface 54 and a plurality of bristles 66 projecting outwardly therefrom. The bristle section 34 of brush 18 extends longitudinally from the distal end 36 a distance L towards proximal end 40. The core may be formed from a variety of materials, including plastics, and in some embodiments the core may be non-metallic. The outer surface 54 of the core 50 has a surface area that corresponds directly with the volume of formulation that the brush 18 can hold. In particular, and with reference to FIG. 4, a formulation layer 74 may tend to form around the core 50. Such a formulation layer 74 advantageously enables transfer of the formulation to the hairs of a subject. That is, the larger the surface area of the core 50, the more formulation the brush 18 can hold, all else equal. The ability to hold more formulation may be advantageous. In addition to influencing how much formulation can be stored on the brush 18, the surface area of the core 50 is also a key factor in bristle density. As will be discussed in more detail below, the bristle density of a given brush can greatly affect its ability to efficiently and uniformly transfer formulation to hairs of a subject. Namely, when bristle density is too high relative to the surface area of the core, fine hairs may not be able to enter gaps between adjacent bristles, and formulation may tend to clump together.

Returning to FIG. 2, a longitudinal axis 58 is shown extending parallel to the core 50 through its center in order to facilitate visualization of the various features of the brush 18. The length of the core may vary between embodiments, but generally is about 10 mm to about 50 mm. In the embodiment of FIG. 2, the length L of core 50 is 30 mm. In other embodiments, the core may have a length L of 20 mm, 25 mm, 40 mm, or other length, although these core lengths are merely exemplary.

Generally, the core 50 has a cross sectional shape when viewed in a two-dimensional plane that is normal to the longitudinal axis 58. In some embodiments, the cross sectional shape is constant along the longitudinal axis. For example, referring to FIG. 4, the brush 18 has a cylindrical core 50 with a circular cross sectional shape when viewed in a plane that is normal to any point along the longitudinal axis 58. In some embodiments, the core 50 has an outside diameter D of 2.6 mm, which equates to a circumference of $2.6\pi$ mm. In embodiments where the bristled section of the core 50 has a length L of 30 mm, the total nominal bristled surface area is approximately 245 $mm^2$, not considering the surface area occupied by the bristles themselves. In other embodiments, the cross sectional shape is not constant along the longitudinal axis 58, but instead varies along the length L of core, or sections thereof. In yet other embodiments, the cross sectional shape remains constant along the longitudinal axis 58 but can vary in cross sectional area along the length L of core, or sections thereof. One example of such an embodiment is discussed below with respect to FIG. 10-14.

Brushes of the present disclosure include one or more high density zones having a plurality of bristles 66 that protrude radially outward from the core 50. The bristles conform to certain bristle density criteria that enable efficient and uniform transfer of formulations to fine hairs, such as eyelashes. The brush may include a single high density zone or a plurality of high density zones. In some embodiments, one or more high density zones may substantially make up the entire brush. For example, the brush 18 of FIGS. 1-5 includes a single high density zone 62 that has a length equal to the length L of the bristle section 34. The following discussion concerns such high density zones. Generally, the high density zone may include between about 500 to about 1,500 total bristles, for example about 600 to about 1,000 total bristles, or between about 600 and about 799 total bristles. It is contemplated that brushes of the present disclosure may have one or more zones that are not high density zones as described herein in addition to at least one high density zone.

The bristles serve several important functions, for example storing formulation, breaking up formulation into smaller amounts, separating hairs of the subject, and transferring the formulation to the hairs of the subject. In the brush 18 of FIGS. 2-4, the high density 62 zone includes bristles 66 arranged in a plurality of bristle rings 70 that are spaced apart along the core 50, with each successive bristle ring $\mathbf{70}_{a,c}$ staggered relative to each adjacent bristle ring $\mathbf{70}_{b,d}$ about the longitudinal axis by an angle β of 15 degrees. In some embodiments, the brush 18 includes 100 bristle rings 70, although different embodiments may include a different number of rings. When viewed from both the side as in FIG. 3 and from the end as in FIG. 4, it can be seen that each bristle ring 70 is oriented substantially normally to the longitudinal axis 58 of the core 50. In other embodiments however, bristle rings may have one or more orientations that are not perpendicular to the longitudinal axis of the core. For example, a bristle ring may have an oblique orientation relative to the longitudinal axis, and may intersect with other bristle rings, subject to the limits of bristle density discussed below. In still other alternative embodiments, the bristles may not form discrete rings, but rather one or more continuous helixes around the core for example. As noted above with respect to angle β, bristle rings may have different angular orientations with respect to the longitudinal axis when viewed in a two-dimensional plane that is normal to the longitudinal axis. For example, in other embodiments, bristle rings may be offset from each other about the longitudinal axis by about 0 to about 90 degrees, for example about 5 degrees, about 10 degrees, about 20 degrees, about 22.5 degrees, about 25 degrees, or another angle, etc. It is contemplated that bristle rings may have any orientation disclosed in U.S. Pat. No. 8,393,338, which is hereby incorporated by reference in its entirety.

Figure 3:
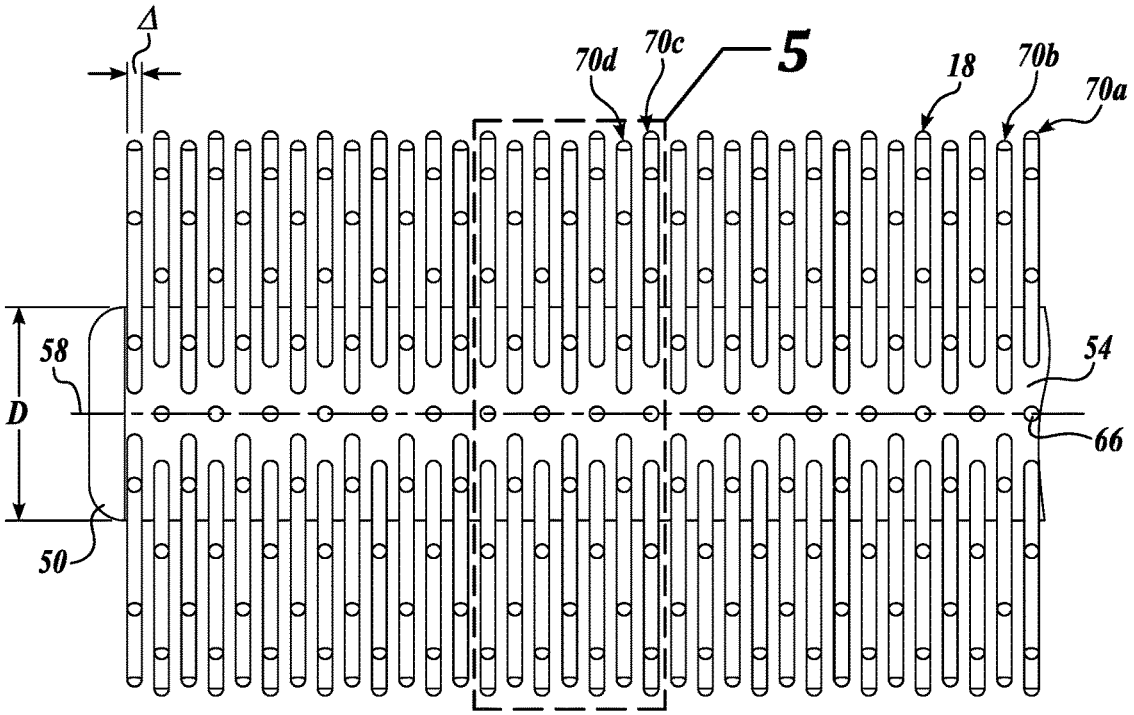
FIG. 3 is a partial side view of the brush of FIG. 2.
Figure 4:
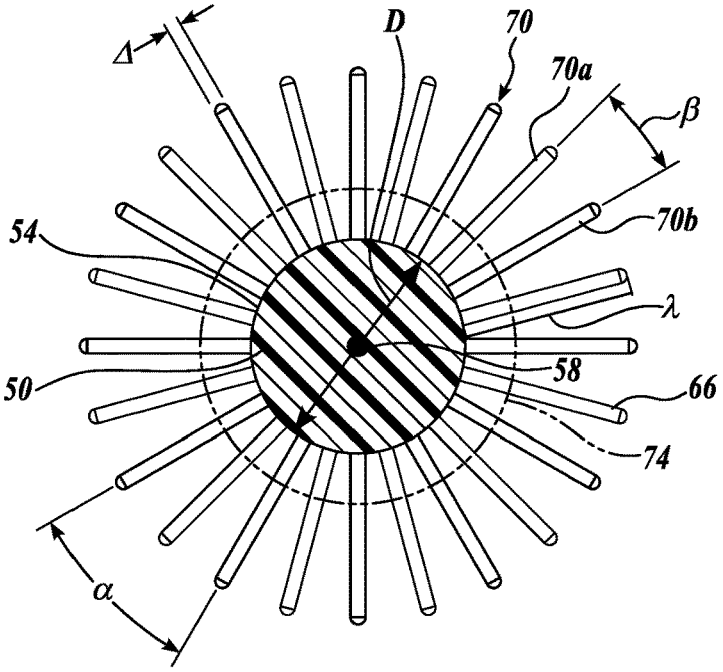
FIG. 4 is a section view of the brush of FIG. 2.
Figure 5:
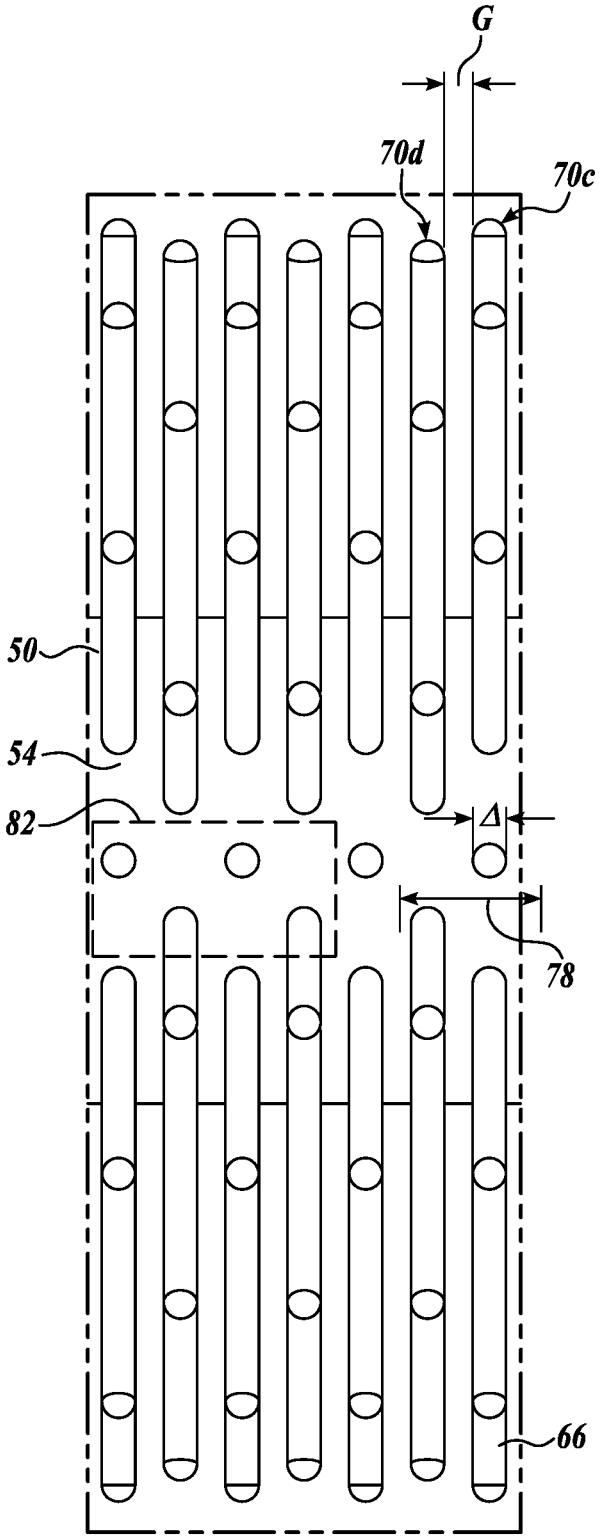
FIG. 5 is another partial side view of the brush of FIG. 2.
Figure 6:
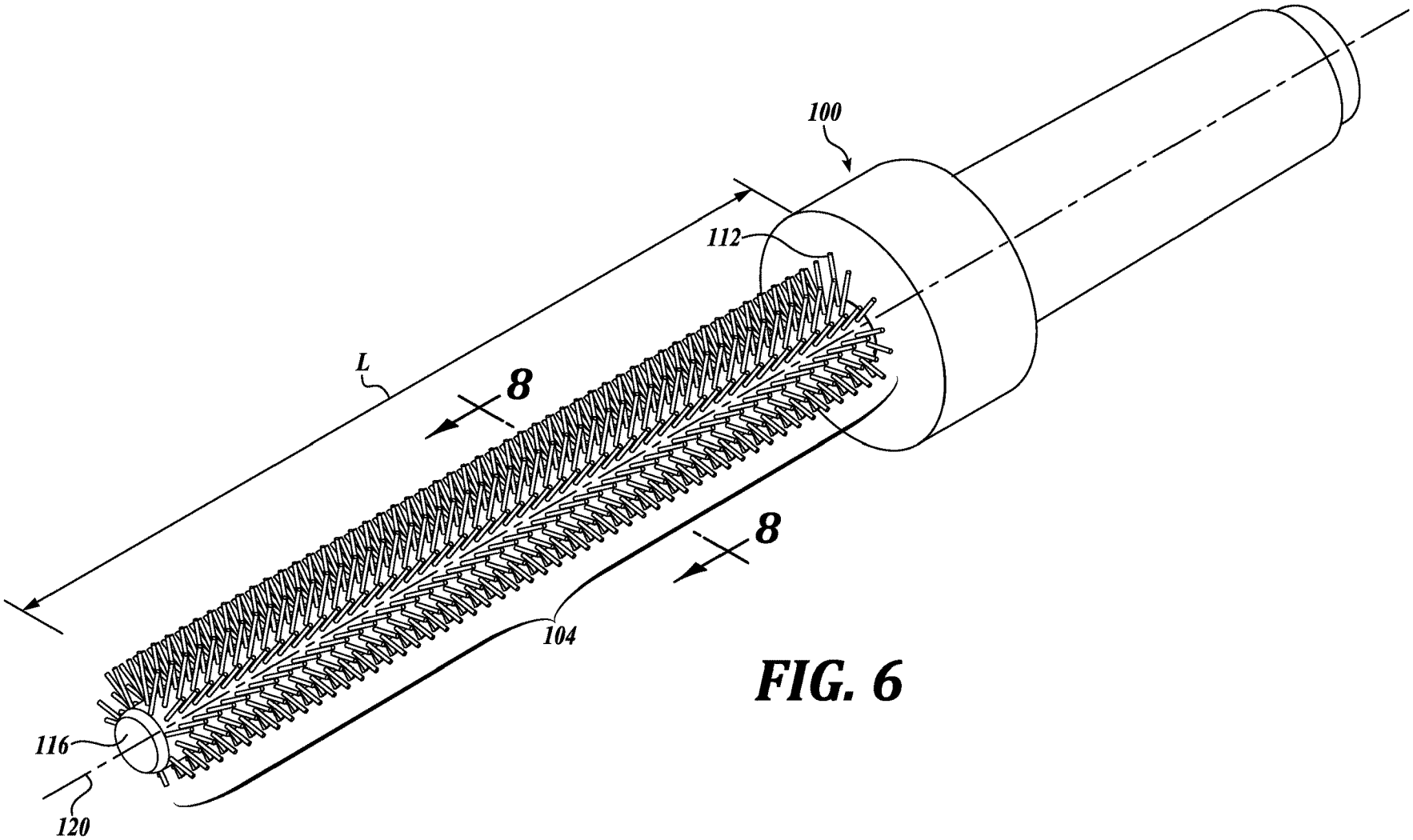
FIG. 6 is a perspective view of another embodiment of a brush according to one or more aspects of the present disclosure, the brush being suitable for use with the container of FIG. 1.
Figure 7:
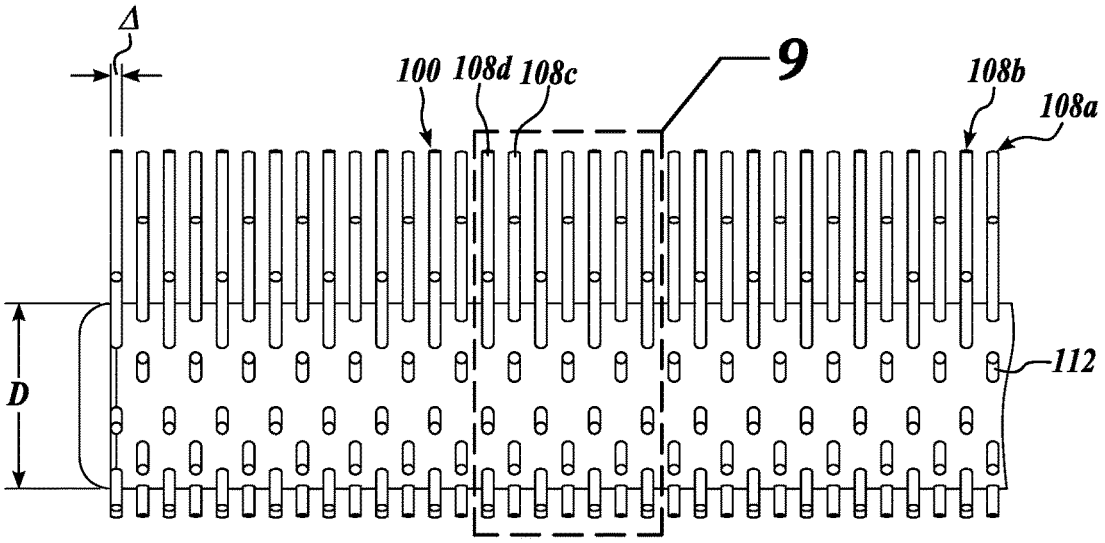
FIG. 7 is a partial side view of the brush of FIG. 6.

Each bristle ring 70 typically, but not always, extends all the way around the core 50. Referring to FIGS. 2-4, each bristle ring 70 extends entirely around the outer surface 54 of the core 50, i.e., 360 degrees around the longitudinal axis 58. These "full" bristle rings 70 are preferred for applying formulation to fine hairs. However, it is contemplated that in other embodiments, a high density zone may include one or more bristle rings that only partially extend around the outer surface of the core, i.e., partially around the longitudinal axis, for example about 90 degrees, about 120 degrees, about 180 degrees, or another value that is less than 360 degrees.

Each bristle may generally be formed from any thermoplastic material that is optionally relatively rigid, e.g.: styrene-ethylene-butylene-styrene (SEBS); a silicone rubber; latex rubber; a material having good slip; butyl rubber; ethylene-propylene terpolymer rubber (EPDM); a nitrile rubber; a thermoplastic elastomer; a polyester, polyamide polyethylene, or vinyl elastomer; a polyolefin such as polyethylene (PE) or polypropylene (PP); polyvinyl chloride (PVC); ethyl vinyl acetate (EVA); polystyrene (PS); SEBS; styrene-isoprene-styrene (SIS); polyethylene terephthalate (PET); polyoxymethylene (POM): polyurethane (PU); styrene acrylonitrile (SAN); polyamide (PA); or polymethyl methacrylate (PMMA). It is also possible to use a ceramic. e.g. an alumina-based ceramic, a resin, e.g. a urea formaldehyde type resin, possibly a material filled with graphite. In particular, it is possible to use materials known under the trade names Teflon, Hytrel®, Cariflex®, Alixin®, Santoprene®, Pebax®, Pollobas®, this list not being limiting. Preferably, each bristle is formed from at least one thermoplastic elastomer.

The dimensions of individual bristles may vary between embodiments. In particular, the bristle length and bristle diameter can greatly influence brush performance. As used herein, bristle length is measured as the exposed length of a bristle that projects radially outwardly beyond the outer surface 54 of the core 50—not the length considering any additional bristle length below the outer surface of the core. It has been discovered that in high density zones, bristle lengths of about 0.5 mm to about 4.0 mm are preferred for applying formulations to fine hairs, for example bristle lengths of about 0.6 mm, about 1.0 mm, about 1.25 mm, about 1.5 mm, about 2.0 mm, about 3.0 mm, and about 3.5 mm. Referring to FIG. 4, each bristle 66 of the brush 18 has a length λ, of 2.0 mm, which reflects the length of each bristle 66 that extends beyond the outer surface 54 of the core 50. The range of appropriate bristle lengths for a given application may depend on the bristle material. For example, bristles may have lengths ranging from about 0.6 mm to about 4.0 mm, e.g., about 0.6 mm to about 2.0 mm, or about 1.5 mm. Further, a single brush, and even a single bristle ring, may include bristles of more than one length. The lengths of successive bristles may vary, for example in a continuously increasing or decreasing pattern, an alternating pattern, or another pattern, such that the different bristle lengths provide targeted advantages. It is contemplated that bristle rings may have bristle lengths as disclosed in U.S. Pat. No. 8,393,338, which is incorporated by reference in its entirety. In some embodiments, no more than, for example, 8, 7, 6, 5, 4, 3, or 2 bristles may have the same bristle length. In some embodiments, a single bristle ring may include one or more bristles with a first bristle length and one or more bristles with a second bristle length, which may differ by about 0.1 mm to about 3.5 mm, e.g., about 1.0 mm, about 2.0 mm, or about 3.0 mm. In some embodiments, for example, 1, 2, 3, 4, 5, or more consecutive bristles within the same bristle ring of the high density zone may have the same bristle length. In some embodiments, no two consecutive bristle rings may include bristles of the same bristle length. These features may advantageously provide bristles best suited for different fine hair diameters on a single brush (and even within a single high density zone). Such examples are discussed below with respect to the brushes of FIGS. 6-14.

Bristle diameter, measured where the bristle meets the outer surface of the core, should generally be about 0.05 mm to about 0.35 mm, e.g., about 0.1 mm, about 0.125 mm, about 0.15 mm, about 0.175 mm, and about 0.2 mm, subject to the bristle density limits discussed below. Bristles having diameters in this range generally exhibit sufficient stiffness while also permitting the brush to have bristle density within the limits discussed below. For example, the brush 18 of FIGS. 2-4 has bristles with a diameter Δ, of about 0.175 mm.

The number of bristles per bristle ring may vary between embodiments. "Full" bristle rings, i.e., bristle rings that extend completely around the outer surface of the core (i.e., 360 degrees about the longitudinal axis), may each include 2 to 30 bristles in high density zones, and preferably 7 to 15 bristles per ring, for example 7, 8, 9, 10, 11, 12, 13, 14, 15, 16, 18, 20, 22, 24, 26, 28, 30, or any other number of bristles in that range. In full rings, the number of bristles is the "full ring bristle count." For example, each bristle ring 70 of the brush 18 of FIGS. 2-5 includes 12 bristles, which are spaced apart about the longitudinal axis 58 by an angle α of about 30 degrees. Therefore, each bristle ring 70 has a full ring bristle count of 12 bristles.

In other embodiments, a partial bristle ring, i.e., a ring sector that does not extend completely around the outer surface of the core (i.e., that does not extend 360 degrees about the longitudinal axis of the core), may also include 2 to 30 bristles. For example, a partial bristle ring may include a sector that extends only 180 degrees about the longitudinal axis and includes 6 bristles in that 180 degree sector, each bristle being spaced apart from the adjacent bristles by an angle α of 30 degrees. Similarly, a single bristle ring may include bristles that have different angular spacing a about longitudinal axis of the core. For example, a single bristle ring may include a first 120 degree sector with 3 bristles spaced apart by 40 degrees, a second 120 degree first sector with 4 bristles spaced apart by 30 degrees, and a third 120 degree sector with 5 bristles spaced apart by 24 degrees. These configurations are merely exemplary. Other embodiments may include partial or full bristle rings having a different number of bristles and different angular spacing, within the limits of bristle density discussed below.

In embodiments with partial bristle rings or bristle rings with heterogeneous angular spacing, it can be useful to think of such partial or heterogeneous bristle rings by reference to an equivalent "full-ring bristle count," which may be calculated by multiplying a) the number of bristles in the densest angular sector of the partial ring and b) the number of such angular sectors that would fit within a 360 degree ring. For example, in the first example from the previous paragraph, the partial bristle ring that extends 180 degrees around the core and includes 6 bristles would have a full-ring bristle count of 6 bristles*(360/180)=12 bristles. In the second example from the previous paragraph, the 3-sector heterogeneous bristle ring has a full-ring bristle count based upon its densest sector. i.e., 5 bristles*(360/120)=15 bristles.

The spacing between adjacent bristle rings is another important variable within high density zones. As noted above, fine hairs generally have diameters ranging from about 0.05 mm to about 0.1 mm. Adjacent bristle rings should be sufficiently spaced apart along the longitudinal axis such that fine hairs may enter that space—generally at least 0.1 mm. Insufficient spacing (e.g., less than 0.1 mm) not only makes it difficult for individual hairs to enter the spacing between bristles, but may also lead to undesirable clumping because the formulation does not have space to break apart. On the other hand, excessive spacing between adjacent bristles may result in inadequate transfer of formulation to the hairs of a subject because individual hairs pass between bristles without making contact with formulation stored on and around the bristles. This condition leads to inefficient formula transfer. Excessive spacing may also result in inadequate separation of the hairs, which can lead to irregular clumping of formulation on the hairs. To overcome these challenges, adjacent bristle rings of the inventive brushes disclosed herein may be spaced apart by a gap of between about 0.1 mm and about 0.3 mm, subject to the bristle density limitations discussed below. The aforementioned gap refers to the distance, measured along the longitudinal axis, between the nearest surfaces of adjacent bristle rings when viewed in a two-dimensional plane parallel to the longitudinal axis, and is not affected by an axial offset between adjacent bristle rings. For example, referring to FIG. 5, adjacent bristle rings $\mathbf{70}_c$, $\mathbf{70}_d$ are spaced apart by a gap G of about 0.15 mm.

Bristle density is a key variable in high density zones configured to efficiently and uniformly transfer formulations—especially gummy formulations—to fine hairs. More than one measure of bristle density impacts brush performance. One key measure of bristle density is the number of bristles relative to the core length, i.e., "linear bristle density." It has been discovered that in order to optimally transfer gummy formulations to fine hairs, a high density zone should have a linear bristle density of 13 to 31 whole bristles per 0.5 mm of length along the outer surface of the core measured parallel to the longitudinal axis. For example, linear bristle densities of 14, 15, 16, 17, 18, 19, 20, 21, 22, 23, 24, 25, 26, 27, 28, 29, 30, and 31 whole bristles per 0.5 mm of core length may be suitable. In the inventive brushes disclosed herein, 1 to 3 "full" bristle rings will fit within each 0.5 mm of core length within the high density zone, measured along the longitudinal axis. As a metric, the linear bristle density captures several specifications that impact brush performance, including bristle diameter (Δ), angular bristle spacing within a bristle ring (α), as well as spacing between bristles of adjacent bristle rings (G). When linear bristle density exceeds 31 bristles per 0.5 mm of core length, the bristles tend to not allow fine hairs to enter the gaps between bristles and tend to clump the formulation. The "full-ring linear bristle density" is calculated by first converting all bristle rings within the high density zone to their "full-ring bristle count," then measuring a 0.5 mm length parallel to the longitudinal axis of the core, and counting the number of "full-ring" bristles within the high density zone that would be encompassed by the 0.5 mm length. For example, referring again to FIGS. 2-5, the high density zone 62 of the brush 18 has 100) full bristle rings 70, each with 12 bristles (and therefore each bristle ring 70 has a "full ring" bristle count of 12 bristles). Each bristle 66 has a 0.175 mm diameter, and adjacent bristle rings 70 are spaced apart by gap G of 0.15 mm. Thus, two full bristle rings $\mathbf{70}_c$, $\mathbf{70}_d$ "fit" within a 0.5 mm length 78 measured along the core 50 (e.g., 0.175 mm+0.15 mm+0.175 mm=0.5 mm). Because each bristle ring 70 has a full ring bristle count of 12 bristles, the high density zone 62 has a full ring linear bristle density of 12 bristles*2 rings=24 bristles per 0.5 mm length along the core 50. It is important to note that other brushes having different bristle counts, bristle diameters, gaps, and angular spacing could achieve the same 24 bristle full-ring bristle density per 0.5 mm of core length. For example, a hypothetical brush with 8 bristles per full ring, each bristle having a 0.1 mm diameter, and adjacent rings spaced apart by 0.1 mm, would also have a full ring bristle density of 24 bristles per 0.5 mm of core length because three full bristle rings would fit within a 0.5 mm core length.

Another key measure of bristle density is the number of bristles relative to the core surface area, or "surface bristle density." It has been discovered that in order to efficiently and uniformly transfer formulation to fine hairs, a high density zone should have a surface bristle density of 3-5 whole bristles per square millimeter of surface area of the core (i.e., the nominal core surface area, not considering the surface area occupied by the bristles themselves), as brushes with a surface bristle density that exceeds 5 whole bristles per square millimeter of surface area (i.e., 6/mm$^2$ or greater) tend to not allow fine hairs to enter the gaps between bristles and tend to clump the formulation. As a metric, the surface bristle density captures several specifications that influence brush performance, including bristle diameter (Δ), angular bristle spacing (α), spacing between bristles of adjacent bristle rings along the longitudinal axis (G), and the amount of core surface area that available to store formulation. The surface bristle density of a high density zone is the greater of a local measurement and an average measurement—neither should exceed 5 whole bristles per square millimeter of surface area. To determine the local surface bristle density within a high density zone, a 1 mm by 1 mm square in a plane that is tangential to the surface of the core is drawn, and then the number of whole bristles that fit within that 1 mm×1 mm square is counted. For example, referring to the detail view of FIG. 5, 4 whole bristles fit within the 1 mm×1 mm box 82 that is tangential to core 50. i.e., a local surface bristle density of 4 whole bristles/mm$^2$. By comparison with the local surface bristle density, the average surface bristle density is determined by dividing the total number of bristles covering the core surface area corresponding to the high density zone, by the radial outer surface area of the high density zone itself. Referring again to FIGS. 2-5, the brush 18 has 1,200 bristles within the high density zone 62 (100 bristle rings, each with 12 bristles), and the cylindrical core 50 has a 2.6 mm outer diameter D, and a 30 mm length L, which equates to a 245 mm$^2$ surface area (2.6π mm×30 mm). Therefore, the brush 18 has an average surface bristle density of 1,200 bristles/245 mm$^2$=4.9 bristles/mm$^2$ (i.e., 4 whole bristles). From this, it is evident that the local and average surface bristle densities are the same: 4 whole bristles per square millimeter.

To clarify, inventive brushes of the present disclosure have (1) a high density zone with a linear surface bristle density 13 to 31 whole bristles per 0.5 mm of length along the outer surface of the core measured parallel to the longitudinal axis and (2) a surface bristle density of 3 to 5 whole bristles per square millimeter of core surface area (taken as the greater of the local or average surface bristle density measurements described above).

Figure 8:
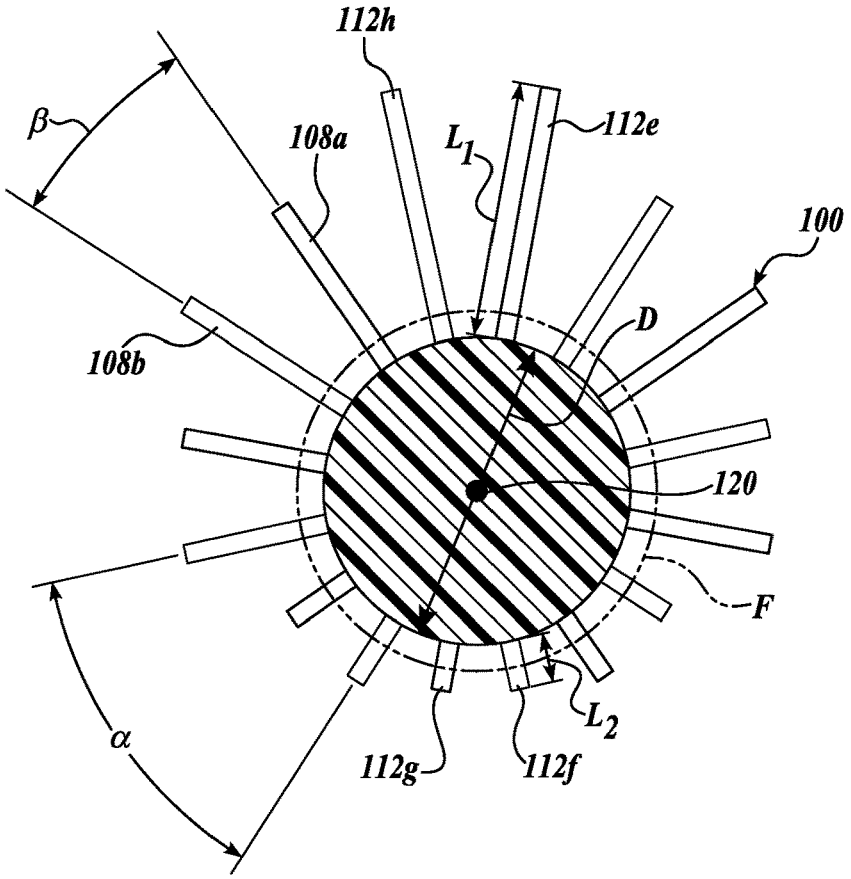
FIG. 8 is a front view of the brush of FIG. 6.
Figure 9:
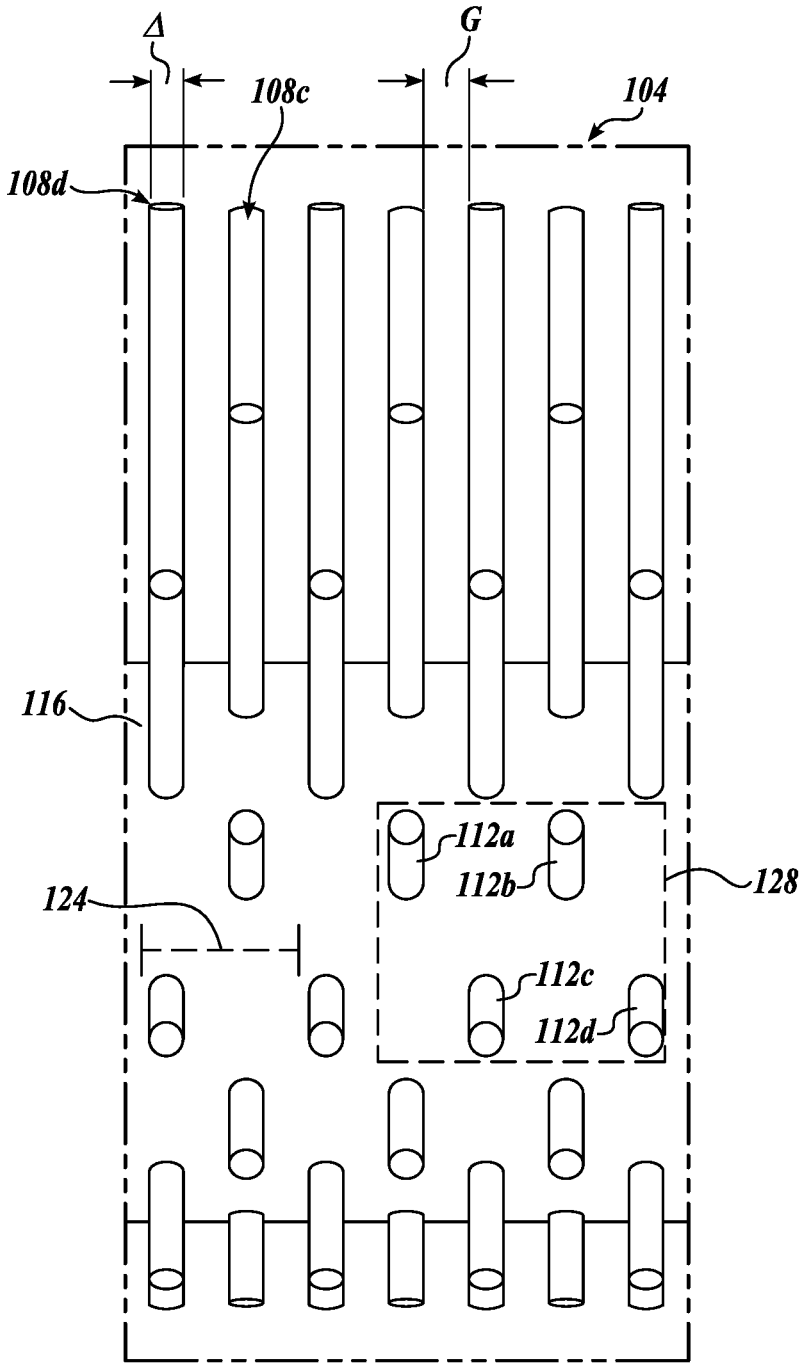
FIG. 9 is another partial side view of the brush of FIG. 6.
Figure 10:
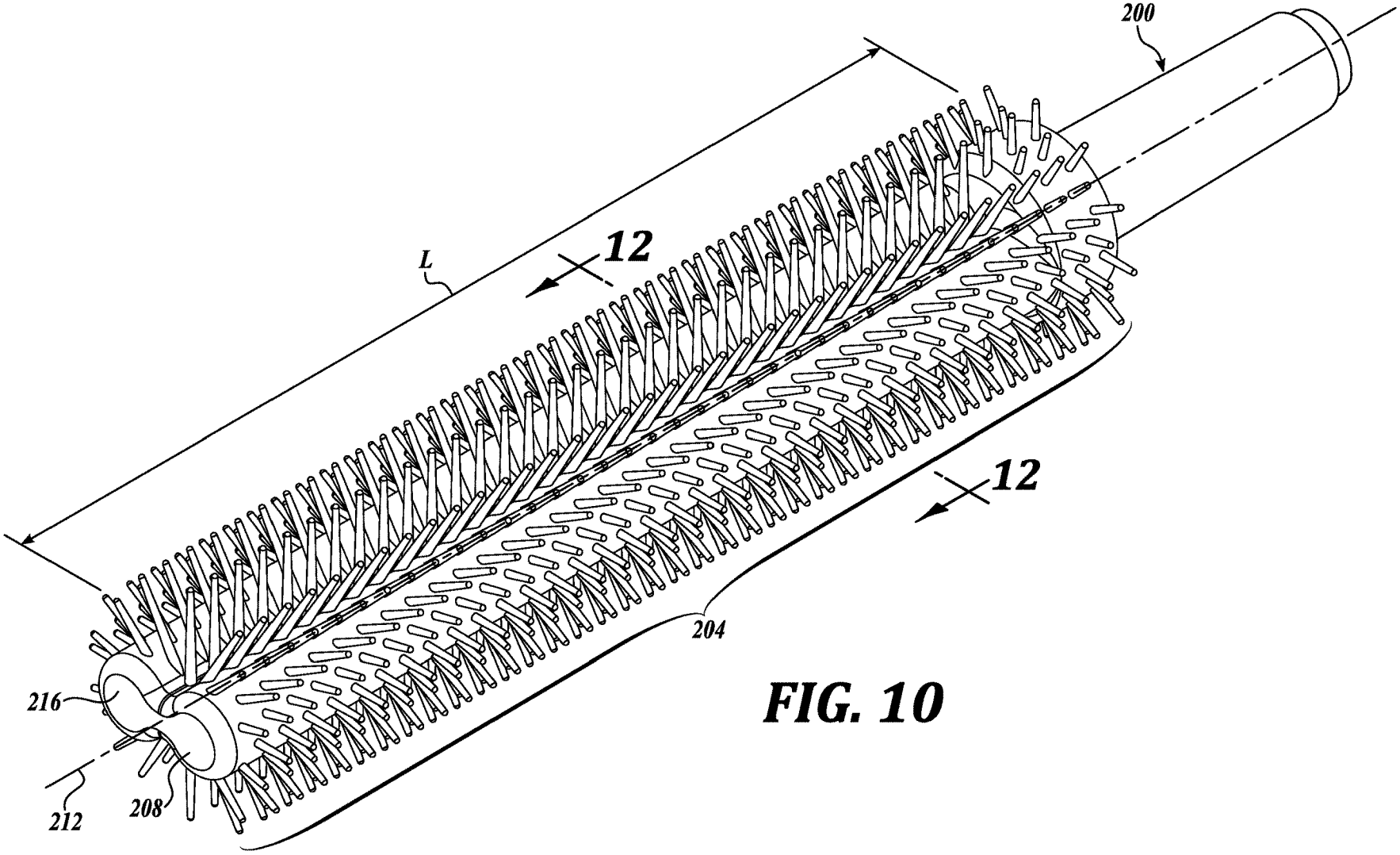
FIG. 10 is a perspective view of another embodiment of a brush according to one or more aspects of the present disclosure, the brush being suitable for use with a container such as is shown in FIG. 1.
Figure 11:
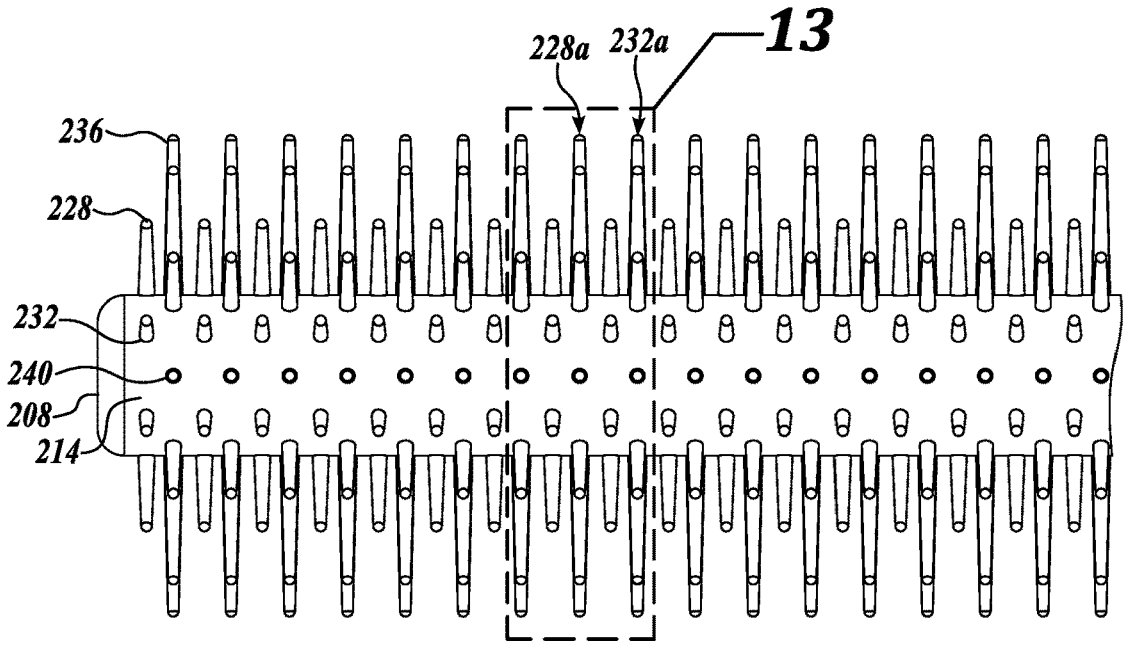
FIG. 11 is a partial side view of the brush of FIG. 10.

Referring now to FIGS. 6-9, another non-limiting example of a brush 100 is shown having a single high density zone 104 that includes 100 bristle rings 108, each having 8 bristles with a 0.15 mm diameter Δ. Whereas each bristle ring of the brush of FIGS. 1-5 has 12 bristles spaced apart by an angle α of 30 degrees, each bristle ring 108 of the brush 100 of FIGS. 6-9 has 8 bristles 112 spaced evenly about the longitudinal axis 120 at an angle α of 45 degrees. In other words, each bristle ring 108 as a full ring bristle count of 8. Adjacent bristle rings $\mathbf{108}_a$, $\mathbf{108}_b$ are offset about the longitudinal axis 120 by angle β, which is 22.5 degrees. Adjacent bristle rings 108 are evenly spaced along the longitudinal axis by a gap G of 0.2 mm along a cylindrical core 116 having a length L of 25 mm, a diameter D of 2.5 mm, the core 116 having a constant cross sectional shape and dimensions along a longitudinal axis 120. In this embodiment, the high density zone extends the entire length of the core 116, and therefore has the same length. As shown in FIG. 9, two full bristle rings $\mathbf{108}_{c,\ d}$ fit within a 0.5 mm length 124 along the core; therefore, the brush has a linear bristle density of 16 bristles per 0.5 mm of core length. FIG. 9 also shows that the brush 100 has a local surface bristle density of 4 bristles, since whole bristles $\mathbf{112}_a$, $\mathbf{112}_b$, $\mathbf{112}_c$, and $\mathbf{112}_d$ fit within the 1 mm×1 mm area box 128. The average surface bristle density is approximately 4.1 bristles per mm$^2$ (i.e., 4 whole bristles), calculated as the total number of bristles 112 within the high density zone (100 rings×8 bristles per ring=800 bristles) divided by the surface area of the high density zone 104 (2.5π mm×25 mm=196.3 mm$^2$). Thus, the high density zone 104 has a linear bristle density of 13 to 31 whole bristles per 0.5 mm of core length, and a surface bristle density of 3 to 5 whole bristles per mm$^2$.

The brush 100 of FIGS. 6-9 provides an additional advantage because each bristle ring 108 includes bristles 112 having different lengths. Referring to FIG. 8, when the brush 100 is viewed in a plane that is normal to the longitudinal axis 120, it can be seen that the bristle $\mathbf{112}_e$ has a first length $L_1$, while the bristle $\mathbf{112}_f$ has second length $L_2$. Moving clockwise from bristle $\mathbf{112}_e$ to bristle $\mathbf{112}_f$, successive pairs of bristles 112 have shorter lengths than the preceding pairs of bristles 112. Similarly, moving clockwise from bristle $\mathbf{112}_g$ to bristle $\mathbf{112}_h$, successive bristle pairs have a longer length than the preceding bristle pair. Advantageously, this aspect enables the brush 100 to efficiently and uniformly transfer formulation to a wide variety of fine hairs, thus making the brush 100 suitable for a greater number of potential subjects. The brush 100 of FIGS. 6-9 is a non-limiting example of this concept. Other brushes may include bristles having different lengths.

Brushes of the present disclosure may provide additional advantages by including at least one external recess for holding formulation. Such recesses are formed within, or by, the outer surface of the core, which recesses then hold formulation by surface tension. By storing formulation, the recesses reduce the frequency with which a brush must be reloaded with formulation, and also provides more formulation to transfer to the hairs of a subject in a single stroke. Such recesses may cooperate with other structure(s) designed to store formulation, e.g., cavities formed with the core of the brush, but are described herein as distinct from such "internal" cavities. The recesses may be formed by molding the core to a particular shape that inherently includes recesses, and/or by removing material from the core in a separate processing step. Cores having recesses may have organic or geometric cross-sectional shapes, which shapes and dimensions may be constant or may vary along a longitudinal axis. Such recesses may have a depth ranging from about 0.1 mm to about 1.5 mm, e.g., about 0.5 mm to about 1.0 mm, and may have a length ranging from about 1.0 mm to the entire length of the core. It is contemplated that the cores of brushes may have cross sectional shapes as disclosed in U.S. Pat. No. 8,393,338, which is incorporated by reference in its entirety.

Referring now to FIGS. 10-14, a brush 200 is shown having a high density zone 204 and embodies several advantages disclosed herein. Rather than a cylindrical core, the brush 200 includes a core 208 having an hourglass cross sectional shape. The hourglass shape is evident when the brush 200 is viewed along a longitudinal axis 212 as in FIG. 12. A spline 216 defines the hourglass shape of an outer surface 214 of the core 208. The spline 216 in an embodiment has a spline length of about 9.7 mm. The high density zone 204 extends along a length L of about 21.9 mm in some embodiments. Therefore, the outer surface area of the hourglass-shaped core 208 within the high density zone 204 is 9.7 mm×21.9 mm=212.8 $mm^2$ in this embodiment.

Figure 12:
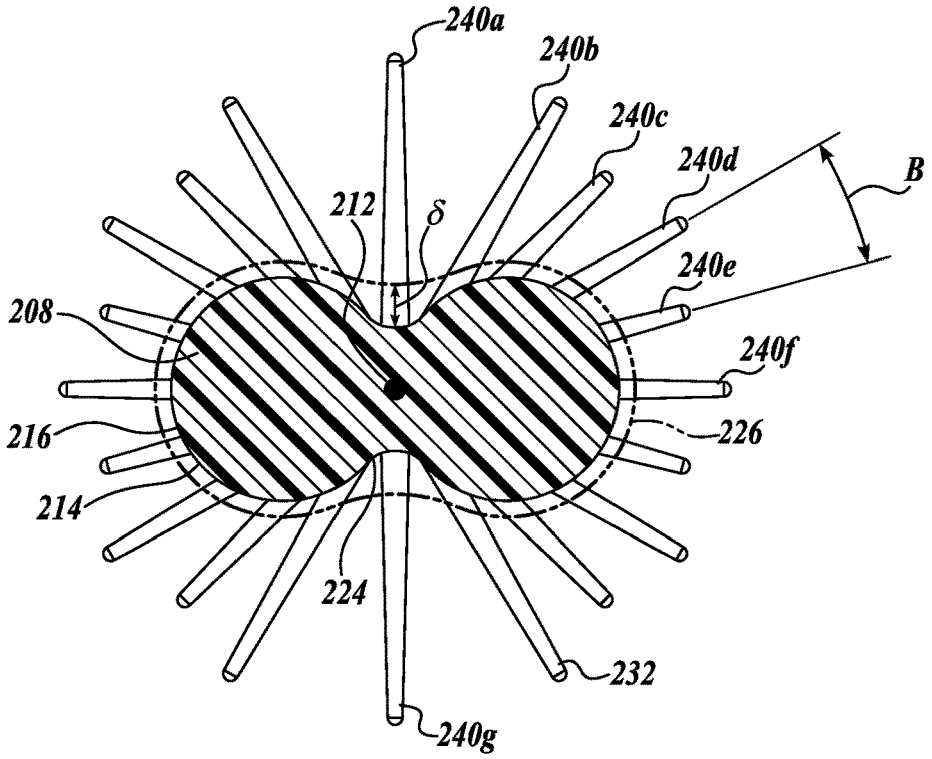
FIG. 12 is a section view of the brush of FIG. 10.

Referring still to FIG. 12, the core 208 advantageously includes a channel-shaped or groove-shaped first recess 220 and an identical second recess 224 located on an opposite side of the core 208. The recesses 220, 224 enable the brush 200 to hold more formulation, which is represented as layer 226 in FIG. 12. Each recess 220, 224 has a depth δ that is measured relative to a plane that is tangential to two radial-outermost points of the core 208. The depth δ of recess 220 is about 0.8 mm, but in some embodiments may range from about 0.1 mm to about 1.5 mm. The first and second recesses 220, 224 extend along the entire length L of the high density zone 204 or sections thereof. The depth δ and length L both correspond directly to a volume of the recesses 220, 224.

Many variations in the quantity, shape, and size of recesses are contemplated, and any brush of the present disclosure may include one or more such recesses—not just the embodiment of FIGS. 10-14. For example, in some embodiments, the core may have a tri-lobe cross-sectional shape that creates three recesses, a cloverleaf shape that creates four recesses, or a geometric shape that includes one or more recesses, such as a star shape. Other embodiments (not shown) may include only a single recess, or a greater number of recesses about the core, e.g., 5, 6, 7, 8, 9, 10, or more recesses. Whereas the recesses 220, 224 of FIGS. 10-14 form channels or grooves in the core 208, recesses in other embodiments may form divots, helixes, axially-spaced rings, and other shapes. In embodiments having a plurality of recesses, it is not essential that all recesses are identical; rather, the recesses may differ relative to each other in length, depth, shape, and other characteristics.

In use, the formulation layer 226 surrounds the core 208 and occupies the recesses 220, 224. As is evident from FIG. 12, the formulation layer 226 has greater depth in the location of the recesses 220, 224. This additional formulation stored around the core 208 enables the brush 200 to transfer more formulation to the hairs of a subject without reloading the brush 200.

Figure 13:
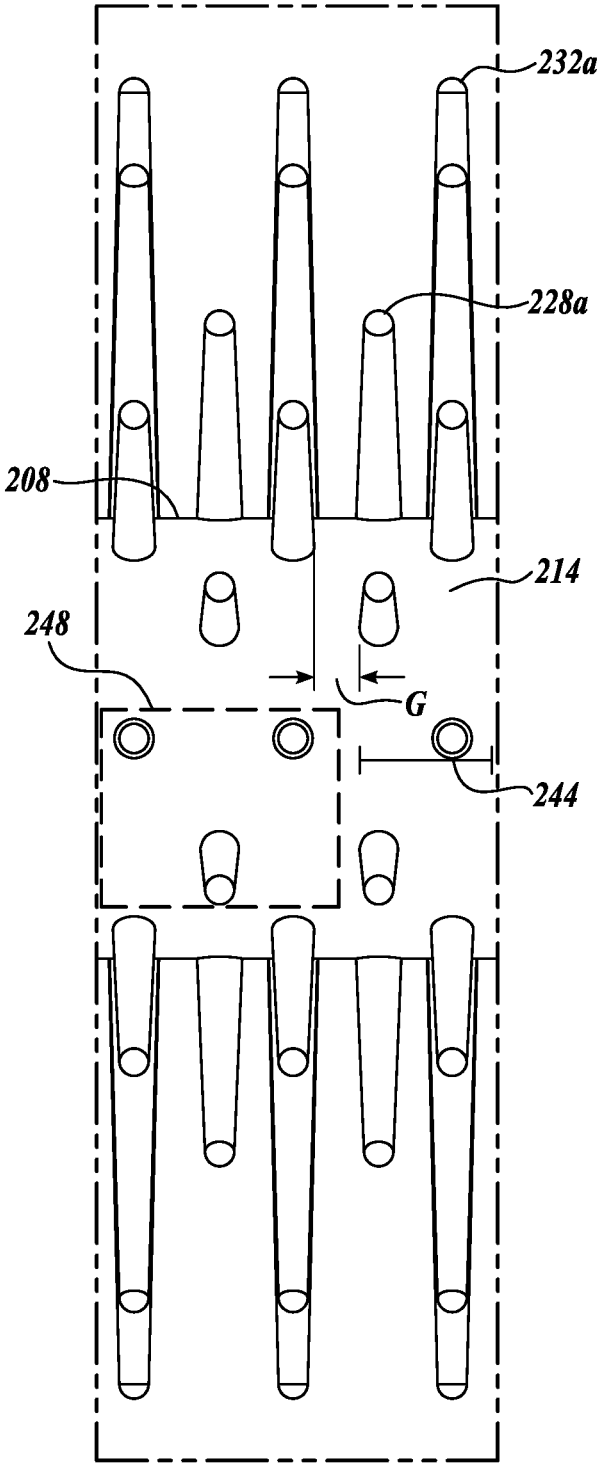
FIG. 13 is another partial side view of the brush of FIG. 10.
Figure 14:
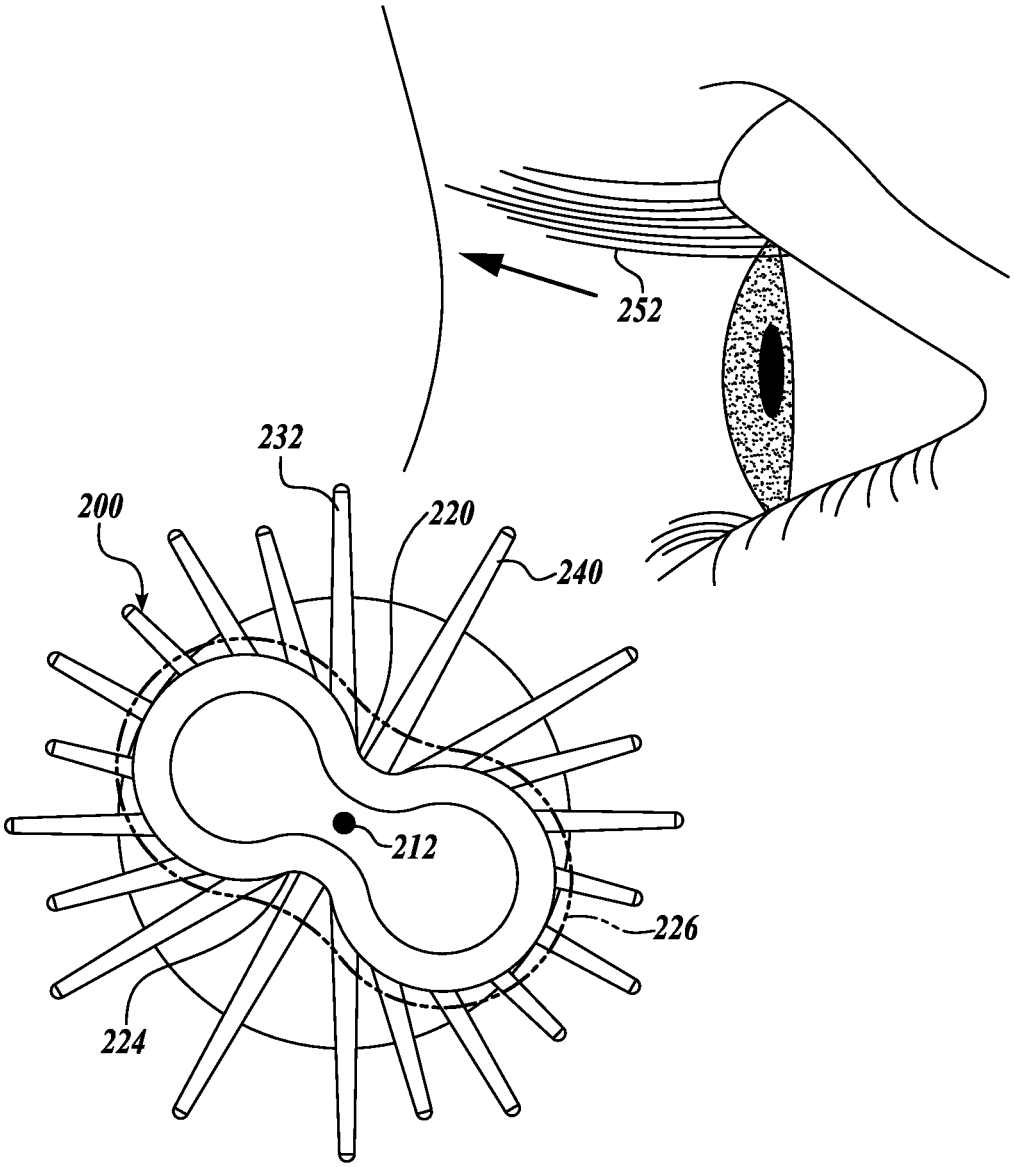
FIG. 14 illustrates a representative method of using the brush of FIG. 10.

The high density zone 204 of the brush 200 of FIGS. 10-14 includes sixty-seven bristle rings spaced apart by about 0.1 mm to about 0.2 mm, e.g., about 0.15 mm. The number of bristles per ring varies—each odd bristle ring 228 has 8 bristles (designated 232) and each even bristle ring 236 has 12 bristles (designated 240), for a total bristle count of 668 bristles. Each successive bristle ring 228, 236 is offset from each preceding and succeeding bristle ring 228, 236 by an angle β of about fifteen degrees, such that when viewed along the longitudinal axis 212 as in FIG. 12, 22 distinct bristles 232, 240 are visible. Each bristle 232, 240 has a base diameter of about 0.2 mm The bristle density of the brush 200 falls within the parameters outlined above. As shown in FIG. 13, two bristle rings $\mathbf{228}_a$, $\mathbf{232}_a$ fit within a 0.5 mm length 244 measured along the core 208. Given that alternating bristle rings 228, 236 have 8 and 12 bristles 232, 240, respectively, this equates to a linear bristle density of 20 bristles per 0.5 mm of core length. The local surface bristle density is 3 whole bristles per square millimeter of core surface area, as visualized by the 1 mm×1 mm box 248 in FIG. 13. The average surface bristle density is calculated by dividing 668 bristles by the 212.8 $mm^2$ surface are of the high density zone, or 3.1 bristles per square millimeter (3 whole bristles).

As yet another advantage, the hourglass-shaped core 208 advantageously causes the bristles 232, 240 to have a plurality of bristle lengths. Referring again to FIG. 12, it is evident that the bristles $\mathbf{240}_a$ and $\mathbf{240}_g$ have the longest bristle length, as they project radially outwardly from the lowest point in the first and second recesses, 220, 224, respectively. Moving clockwise from the bristle $\mathbf{240}_a$, the next visible bristle $\mathbf{240}_b$ has a second bristle length, which is less than the first bristle length because the bristle $\mathbf{240}_b$ does not extend from the lowest point in the first recess 220. Moving clockwise again, the bristle $\mathbf{240}_c$ has a third bristle length, which is less than the first and second bristle lengths because it is a shorter bristle and also because it projects from a relatively higher point on the core 208. Likewise, the bristle $\mathbf{240}_d$ has a fourth bristle length, the bristle $\mathbf{240}_e$ has a fifth bristle length, and the bristle $\mathbf{240}_f$ has a sixth bristle length. From this, it is apparent that shape of the core 208 causes bristles 232, 240 to have different bristle lengths.

In use, a subject may use any of the brushes described herein to apply formulation to hair, such as eyelashes. With reference to the brush 200 of FIGS. 10-14, a subject may first load the brush 200 with formulation by inserting one end into a formulation-storing container (such as is shown in FIG. 1), withdrawing the brush 200, and stroking the brush 200 against one or more hairs 252. Optionally, before stroking the brush 200 against the hairs 252, the subject may selectively rotate the brush 200 about its longitudinal axis 212 before stroking the brush 200 such that hairs of the subject will pass through bristles 232, 240 extending from either recess 220, 224 during a stroke. In other words, the subject may rotate the brush 200 to align the first or second recess 220, 224 with the hairs 252. This step may advantageously increase the amount of formulation that is transferred to the hairs during a subsequent stroke. Optionally, the subject may selectively rotate the brush 200 before stroking such that bristles 232, 240 having a particular bristle length (e.g., a first, second, third, fourth, fifth, or sixth bristle length) will contact the hairs. This step may advantageously position bristles 232, 240 that are best-suited for the hair type of a subject to make contact with the hairs 252 during a stroke. The subject may then perform one or more strokes (preferably outward strokes) with the brush 200 against the hairs 252 in order to transfer formulation to the hairs 252, performing any of the steps described above in between strokes. Optionally, the subject may rotate the brush 200 during a stroke or otherwise while the brush is in contact with the hairs 141, in order to separate the hairs 252 and/or increase the amount of formulation transferred to the hairs 252.

In summary, inventive brushes of the present disclosure are configured to efficiently and uniformly transfer formulations, especially gummy formulations, to fine hairs. Such brushes include at least one high density zone having a linear bristle density of 13 to 31 whole bristles per 0.5 mm of core length and a surface bristle density of 3 to 5 whole bristles per square millimeter of core surface area. This configuration enables fine hairs to enter gaps between bristles and also enables formulation to break apart between the bristles, contrary to known dense brushes. In addition, brushes may have more than one bristle length, which advantageously enables a single brush to efficiently and uniformly transfer formulation to different hair sizes. In addition, brushes may include one or more recesses formed on or in the core, which enable the brushes to store a greater amount of formulation, which advantageously reduces the frequency with which a brush must be reloaded with formulation, and also provides more formulation to transfer to the hairs of a subject in a single stroke.

The detailed description set forth above in connection with the appended drawings is intended as a description of exemplary embodiments of the disclosed subject matter and is not intended to represent the only embodiments. The exemplary embodiments described in this disclosure are provided merely as examples or illustrations of a cosmetic applicator and should not be construed as preferred or advantageous over other embodiments. The illustrative examples provided herein are not intended to be exhaustive or to limit the disclosure to the precise forms disclosed. Similarly, any features and/or process steps described herein may be interchangeable with other features and/or process steps, or combinations of features and/or process steps, in order to achieve the same or substantially similar result.

In the foregoing description, numerous specific details are set forth in order to provide a thorough understanding of the exemplary embodiment of the present disclosure. It will be apparent to one skilled in the art, however, that many embodiments of the present disclosure may be practiced without some or all of the specific details. In some instances, well-known features, subassemblies, and/or process steps have not been described in detail in order not to unnecessarily obscure various aspects of the present disclosure. Further, it will be appreciated that embodiments of the present disclosure may employ any combination of features described herein. For instance, any feature or configuration described above with respect to one wiping assembly may be adapted for use with any other wiping assembly.

Although certain descriptive terms have been used to illustrate or describe certain aspects or benefits of the present invention, they should not be seen as limiting. For instance, the present disclosure also includes references to directions, such as "distal," "proximal," "upward," "downward," "top," "bottom," "first," "second," etc. These references and other similar references in the present disclosure are only to assist in helping describe and understand the exemplary embodiments and are not intended to limit the claimed subject matter to these directions. The term "cosmetic formulation" or "cosmetic" should be interpreted broadly to include any cosmetic formulation, beauty product, lotion, lacquer, etc., generally applied to the skin, eyes, nails, or other body part of a person. Moreover, it should be appreciated that the cosmetic applicators may also be adapted for other non-cosmetic uses, such as applying medicine, paint, etc., to a desired body part or surface.

The present disclosure may also reference quantities and numbers. Unless specifically stated, such quantities and numbers are not to be considered restrictive, but exemplary of the possible quantities or numbers associated with the present disclosure. Also in this regard, the present disclosure may use the term "plurality" to reference a quantity or number. In this regard, the term "plurality" is meant to be any number that is more than one, for example, two, three, four, five, etc. The terms "substantially," "about." "approximately," etc., mean plus or minus 5%. For the purposes of the present disclosure, the phrase "at least one of A, B, and C," for example, means (A), (B), (C), (A and B), (A and C), (B and C), or (A, B, and C), including all further possible permutations when greater than three elements are listed.

The principles, representative embodiments, and modes of operation of the present disclosure have been described in the foregoing description. However, aspects of the present disclosure, which are intended to be protected, are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure as claimed.

The embodiments of the invention in which an exclusive property or privilege is claimed are defined as follows:

1. A brush for holding a formulation, comprising:

a core having an outer surface, a longitudinal axis, a non-cylindrical cross sectional shape, and a first recess formed in or by the outer surface, the first recess being configured to hold the formulation; and a plurality of bristle rings protruding from the core and spaced apart along the longitudinal axis, each bristle ring having a plurality of bristles spaced radially apart around the outer surface of the core, wherein at least one ring of the plurality of bristle rings includes a first bristle length, a second bristle length, and a third bristle length, wherein the plurality of bristle rings includes a high density zone covering at least a portion of the outer surface of the core, the high density zone having an equivalent 360 degree bristle density of 13 to 31 whole bristles per 0.5 mm of length along the outer surface of the core measured along the longitudinal axis and a surface bristle density of 3 to 5 bristles per square millimeter of area of the outer surface of the core, and no two consecutive bristles in a single bristle ring have a same bristle length.

2. The brush of claim 1, wherein the first recess extends along the core in a direction substantially parallel to the longitudinal axis.

3. The brush of claim 1, wherein the core comprises a second recess located on an opposite side of the core from the first recess.

4. The brush of claim 1, wherein the core has an hourglass shape.

5. The brush of claim 1, wherein a first bristle ring and a second bristle ring of the plurality are spaced apart by 0.1 mm to 0.3 mm, as measured along the longitudinal axis, between a plurality of nearest surfaces of the first bristle ring and the second bristle ring.

6. The brush of claim 5, wherein the first bristle ring and the second bristle ring are spaced apart by 0.15 mm to 0.25 mm.

7. The brush of claim 6, wherein each bristle in one of the first bristle ring and the second bristle ring has a diameter of 0.125 mm to 0.175 mm.

8. The brush of claim 1, wherein no part of the brush has a surface bristle density that exceeds 5 whole bristles per square millimeter of area of the outer surface of the core.

9. The brush of claim 1, wherein the high density zone extends along a 10 mm to 50 mm axial length of the outer surface of the core.

10. The brush of claim 9, wherein at least one bristle ring in the high density zone includes the first bristle length and the second bristle length, and wherein the first bristle length differs from the second bristle length, and the third bristle length differs from the first bristle length and the second bristle length.

11. The brush of claim 10, wherein the at least one bristle ring in the high density zone includes the third bristle length.

12. The brush of claim 1, wherein within a single bristle ring of the plurality of bristle rings, no more than four bristles have the same bristle length.

13. The brush of claim 1, wherein a difference between the first bristle length and the second bristle length is at least 1 mm.

14. A system, comprising a formulation stored within a container, a wiper secured within the container, and a brush according to claim 1 that is removably securable within the container.

15. A brush for holding a formulation, comprising:

a core having an outer surface, a longitudinal axis, a non-cylindrical cross sectional shape, and a first recess formed in or by the outer surface, the first recess being configured to hold the formulation; and a plurality of bristle rings protruding from the core and spaced apart along the longitudinal axis, each bristle ring having a plurality of bristles spaced radially apart around the outer surface of the core, wherein, within at least one bristle ring of the plurality of bristle rings, the plurality of bristles includes a first bristle length, a second bristle length, and a third bristle length, wherein the plurality of bristle rings includes a high density zone covering at least a portion of the outer surface of the core, the high density zone having an equivalent 360 degree bristle density of 13 to 31 whole bristles per 0.5 mm of length along the outer surface of the core measured along the longitudinal axis and a surface bristle density of 3 to 5 bristles per square millimeter of area of the outer surface of the core, and no two consecutive bristles in a single bristle ring have a same bristle length.

16. The brush of claim 15, wherein the high density zone extends along a 10 mm to 50 mm axial length of the outer surface of the core.

17. The brush of claim 15, wherein the at least one bristle ring in the high density zone includes the third bristle length, and wherein the first bristle length differs from the second bristle length, and the third bristle length differs from the first bristle length and the second bristle length.

18. The brush of claim 15, wherein within a single bristle ring of the plurality of bristle rings, no more than four bristles have the same bristle length.

19. The brush of claim 15, wherein a first bristle ring and a second bristle ring of the plurality are spaced apart by 0.1 mm to 0.3 mm, as measured along the longitudinal axis, between a plurality of nearest surfaces of the first bristle ring and the second bristle ring.

20. The brush of claim 15, wherein no part of the brush has a surface bristle density that exceeds 5 whole bristles per square millimeter of area of the outer surface of the core.

* * * * *